US011525236B2

(12) United States Patent
Hayden

(10) Patent No.: US 11,525,236 B2
(45) Date of Patent: Dec. 13, 2022

(54) HITCH ASSEMBLY

(71) Applicant: James Hayden, Cheltenham (GB)

(72) Inventor: James Hayden, Cheltenham (GB)

( * ) Notice: Subject to any disclaimer, the term of this patent is extended or adjusted under 35 U.S.C. 154(b) by 402 days.

(21) Appl. No.: 16/761,726

(22) PCT Filed: Nov. 7, 2018

(86) PCT No.: PCT/GB2018/053232
§ 371 (c)(1),
(2) Date: May 5, 2020

(87) PCT Pub. No.: WO2019/092420
PCT Pub. Date: May 16, 2019

(65) Prior Publication Data

US 2020/0332491 A1 Oct. 22, 2020

(30) Foreign Application Priority Data

Nov. 7, 2017 (GB) ..... 1718413

(51) Int. Cl.
*E02F 3/36* (2006.01)

(52) U.S. Cl.
CPC ..... *E02F 3/3622* (2013.01); *E02F 3/3631* (2013.01); *E02F 3/3686* (2013.01)

(58) Field of Classification Search
CPC ..... E02F 3/3622; E02F 3/3631; E02F 3/3686; E02F 3/3681; E02F 3/3604
See application file for complete search history.

(56) References Cited

U.S. PATENT DOCUMENTS

| | | | | |
|---|---|---|---|---|
| 4,042,131 | A * | 8/1977 | Buttke | E02F 3/3677 414/694 |
| 6,862,822 | B1 | 3/2005 | Masse | |
| 2002/0066215 | A1* | 6/2002 | Kaczmarski | E02F 3/3627 37/468 |
| 2007/0134081 | A1* | 6/2007 | Seabolt | E02F 3/3636 414/723 |
| 2007/0201973 | A1 | 8/2007 | McDermott et al. | |
| 2011/0081193 | A1* | 4/2011 | Nilsson | F16D 51/00 403/91 |
| 2014/0212210 | A1 | 7/2014 | Robl et al. | |
| 2020/0332491 | A1* | 10/2020 | Hayden | E02F 3/3631 |

FOREIGN PATENT DOCUMENTS

| | | | | |
|---|---|---|---|---|
| AT | 516867 | A1 | 9/2016 | |
| EP | 0534369 | A1 * | 9/1992 | |
| EP | 1479830 | A1 * | 11/2004 | E02F 3/3668 |
| EP | 1479830 | A1 | 11/2004 | |
| EP | 1679462 | A2 * | 7/2006 | B66C 23/44 |
| GB | 2331064 | A | 12/1999 | |

(Continued)

*Primary Examiner* — Jamie L McGowan
(74) *Attorney, Agent, or Firm* — Standley Law Group LLP; Beverly A. Marsh; Stephen L. Grant

(57) ABSTRACT

A quick hitch for coupling a tool to an excavation arm of an excavator. The quick hitch comprises a connector comprising a first end coupleable to an excavation arm, and a second end coupleable to a tool; and a latching member releasably engageable with the second end of the connector. In use the second end of the connector receives the tool, and the latching member engages with the connector to releasably couple the tool to the connector.

20 Claims, 10 Drawing Sheets

(56) References Cited

FOREIGN PATENT DOCUMENTS

| | | | | |
|---|---|---|---|---|
| WO | WO85/04440 | A1 | 10/1985 | |
| WO | WO2005026454 | A1 | 3/2005 | |
| WO | WO-2005064090 | A2 * | 7/2005 | ..... B66C 1/585 |
| WO | WO2006073351 | | 7/2006 | |
| WO | WO2014147368 | | 9/2014 | |
| WO | WO-2014147368 | A1 * | 9/2014 | ..... E02F 3/06 |

* cited by examiner

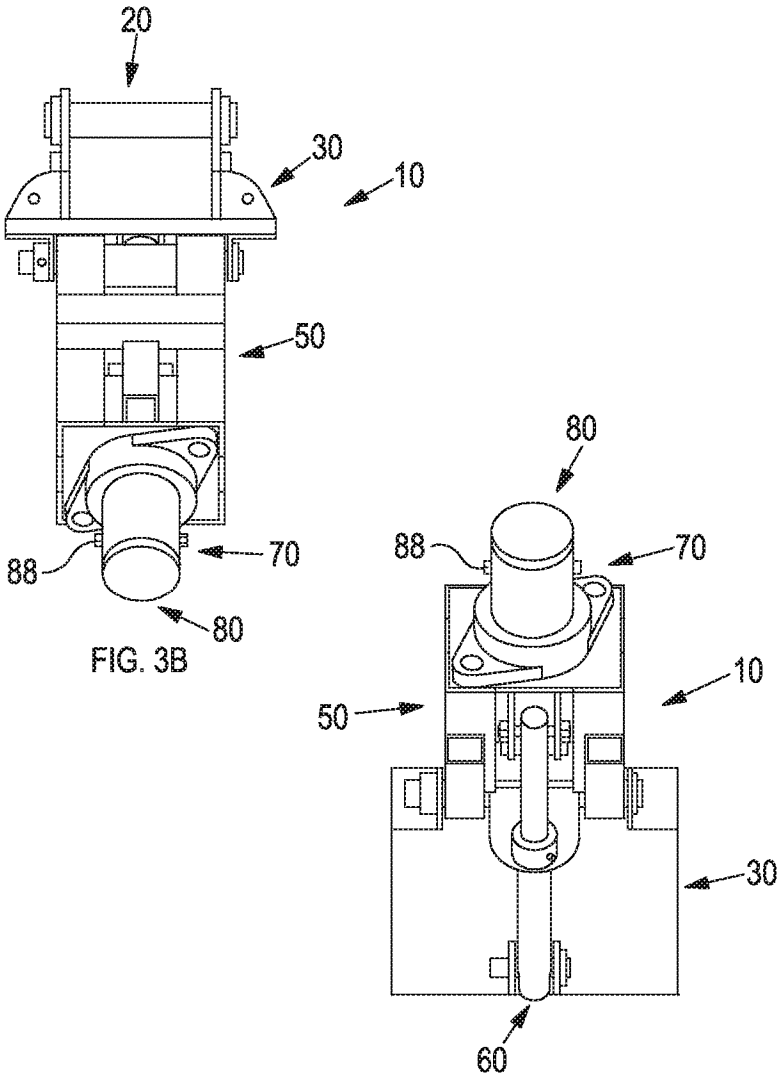
FIG. 3D
FIG. 3B
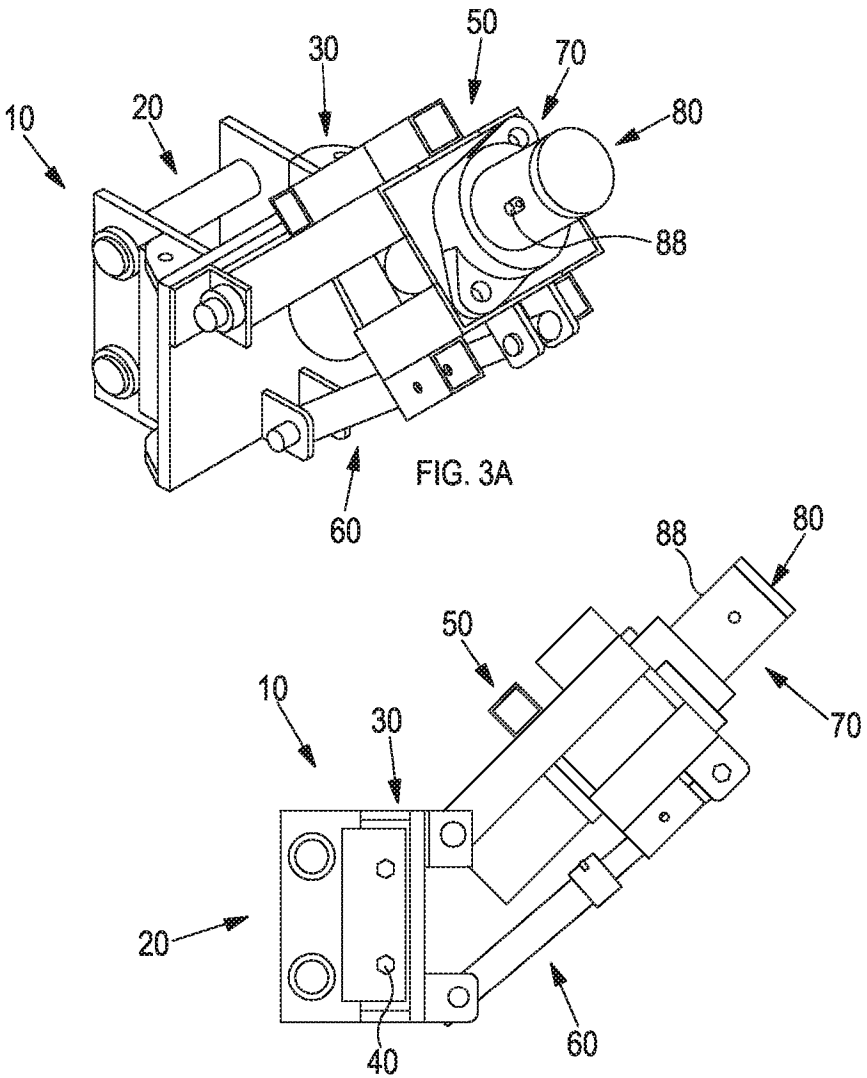
FIG. 3A
FIG. 3C

HITCH ASSEMBLY

FIELD OF INVENTION

The present invention relates to quick hitches and a quick hitch unit for coupling a tool to an excavation arm of an excavator. The present invention further relates to an excavator arm and/or excavator comprising said quick hitches and quick hitch unit.

BACKGROUND OF INVENTION

An excavator (also known as a digger or backhoe) is a construction vehicle typically used to dig and drill into the ground, move large and heavy objects, split wood, cut objects, and so on, depending on the type of attachment used. Excavators typically comprise an arm with an appropriate attachment, and a cab where a user sits and controls the arm. The excavator arm can move up and down, and side-to-side. The arm also typically has an "elbow" joint, which can move the arm backwards and forwards. The attachment however can only pivot towards and away from the arm, thus the attachment itself has quite a restricted range of motion.

Some conventional attachments comprise slots which in use are aligned with hooks on the end of the excavator arm. Once aligned, the user must manually insert mounting pins through the slots and hooks in order to secure the attachment to the arm.

Other conventional attachments comprise two pins which engage with corresponding hooks located at the end of the excavator arm. The pins are then secured within the hooks by a suitable latching mechanism, which is typically hydraulically operated. For example, some excavators have a hydraulically operated wedge under one of the hooks (usually the rear hook), which latches the back pin in place, and thus secures both pins within the hooks. These systems are typically referred to as quick couplers (or quick hitches) and are often automatic, and they remove the need for the user to manually insert/remove the mounting pins. To remove the attachment from the arm, it is necessary to first move the attachment into the correct position such that the latch can be disengaged; the attachment then needs to be moved into the appropriate position to allow the hooks to be disengaged from the pins. The hooks on the excavator arm are now free to engage with pins on a different attachment.

The pins of each attachment have specific dimensions which will only fit into hooks of a corresponding size. Therefore, if a user has multiple excavators having different hook sizes, they will need to purchase multiple versions of the same attachment, each having a different pin size to match each excavator.

Embodiments of the present invention seek to provide an improved quick hitch with increased efficiency and usability, and which overcomes one or more of the known disadvantages of conventional quick hitches described above.

SUMMARY OF INVENTION

According to a first aspect of the present invention there is provided a quick hitch for coupling a tool to an excavation arm of an excavator, the quick hitch comprising:

a connector comprising a first end coupleable to an excavation arm, and a second end coupleable to a tool; and a latching member releasably engageable with the second end of the connector;

wherein in use the second end of the connector receives the tool, and the latching member engages with the connector to releasably couple the tool to the connector.

Advantageously, the invention provides a quick and efficient way to attach and remove the tool coupled to the quick hitch, without having to remove the entire quick hitch itself. The quick hitch remains coupled to the excavator arm during use, and only the tool itself is removed and replaced, which is much quicker than having to replace the whole quick hitch. This can ultimately save the user time, and allow jobs to be completed quicker compared to using conventional hitching means.

The quick hitch may further comprise an attachment member. The attachment member may comprise a base portion for coupling to an excavator tool, and a projection extending away from the base portion.

The connector is cylindrical in shape. The connector may comprise a hollow portion at the second end. The projection may be receivable within the hollow portion of the connector.

The attachment member may comprise a groove or a protrusion (or a lug). The connector may comprise a corresponding protrusion or a corresponding groove, respectively. In use, the groove and corresponding protrusion may interlock when the projection is fully received within the hollow portion.

The latching member may be releasably engageable with the attachment member. The latching member may also be engageable with the second end of the connector.

The attachment member may be attachable to a tool and may be receivable by the connector. The latching member may be engageable with the attachment member and the connector to releasably couple the attachment member to the connector. The latching member may be releasably engageable with the projection and the second end of the connector to releasably couple the projection with the connector.

The base portion may be a flat disc. The base portion may further comprise a second projection extending away from the base portion. The second projection may be threaded.

The latching member may be a pin. The pin may be extendable through alignable through holes on the projection and the second end of the connector. Alternatively, the latching member may be a sprung pin located on the projection, which may be locatable in a corresponding hole in the second end of the connector. The latching member may be a sprung pin which is locatable through a hole in the second end of the connector. The sprung pin may comprise a recess. The recess on the sprung pin may releasably engage in use with a recess on the projection. In a further embodiment, the latching member may be a bolt, such as an allen key bolt. The bolt may be locatable through a hole in the second end of the connector. The bolt may comprise a recess. The recess on the bolt may releasably engage in use with a recess on the projection. The bolt may be secured in place by a fixing member, such as a grub screw with a spring plunger, extending through a top surface of the connector, substantially perpendicular to the bolt.

The quick hitch may further comprise a frame. The second end of the connector may be attachable to a second side of the frame.

The quick hitch may further comprise a base plate. The base plate may comprise first and second faces. The second face of the base plate may be pivotably attachable to a first side of the frame. The first face of the base plate may be removably coupleable to an end of an excavator arm of an excavator.

The quick hitch may further comprise an extendible rod. The extendible rod may be pivotably attachable to the second face of the base plate at a first end and pivotably attachable to a second side of the frame at a second end.

The quick hitch may further comprise a hitching member. The hitching member may be removably coupleable to an end of an excavator arm of an excavator. The hitching member may be removably attachable to the first face of the base plate.

The quick hitch may further comprise at least one fixing member. The at least one fixing member may be arranged to removably attach the hitching member to the base plate.

According to a second aspect of the present invention there is provided a quick hitch unit for coupling a tool to an excavation arm of an excavator, the quick hitch unit comprising:

a base plate comprising first and second faces, the first face removably coupleable to an end of an excavator arm of an excavator;

a frame pivotably attached to the second face of the base plate at a first side, and coupleable to an excavator tool at a second side; and an extendible rod pivotably attachable to the second face of the base plate at a first end and pivotably attachable to the second side of the frame at a second end;

wherein, in use, the rod and frame pivot together relative to the base plate in response to extension of the rod.

The features of the quick hitch unit of the second aspect of the invention are the same as the corresponding features described above with regards to the first aspect of the invention.

Advantageously, the extendible rod provides a greater range of movement for the attached tool, that is the present invention provides the tool with a further degree of freedom. For example, the extendible rod allows the user to further alter the height and the angles of the tool compared to conventional excavator arms. This can be particularly beneficial for attachments such as a cement mixer tool, for example when emptying cement from the cement mixer into the back of a truck it can be useful to have the additional height provided by the extendible rod. Additionally, the extendible rod may allow a grass cutter tool to be rotated such that the tool is positioned substantially on its side, which can help when cutting grass on a slope/hill, or other greenery such as vertical hedges.

The extendible rod may be actuated one of hydraulically, pneumatically and electrically. Alternatively, the extendible rod may be actuated manually.

The frame may be pivotably attachable to an upper portion of the base plate. The rod may be pivotably attachable to a lower portion of the base plate. The frame and the rod may pivot around parallel axes of rotation.

The first and second ends of the rod may comprise through holes configured to receive pins around which the rod pivots in use. The first end of the frame may comprise a through hole configured to receive a pin around which the frame pivots in use.

The frame may comprise a plurality of elongate hollow sections for receiving corresponding frame sections supporting an excavator tool.

The plurality of elongate hollow sections may be attached to both an upper portion of the frame and a lower portion of the frame. In embodiments, at least one elongate hollow section may extend across the width of the frame.

The quick hitch unit may further comprise a hitching member. The hitching member may be removably coupleable to an end of an excavator arm of an excavator. The hitching member may be removably attachable to the first face of the base plate.

The quick hitch unit may further comprise at least one fixing member. The fixing member may be arranged to removably attach the hitching member to the base plate.

The quick hitch unit may further comprise a connector. The connector may comprise a first end attachable to the second side of the frame, and a second end. The second end may comprise a hollow portion.

The quick hitch unit may further comprise an attachment member. The attachment member may comprise a base portion for attaching to an excavator tool. The attachment member may also comprise a projection extending away from the base portion. The projection may be configured to be receivable in the hollow portion in the second end of the connector.

The attachment member may comprise a groove or a protrusion (or a lug). The connector may comprise a corresponding protrusion or a corresponding groove, respectively. In use, the groove and corresponding protrusion may interlock when the projection is fully received within the hollow portion.

The quick hitch unit may further comprise a latching member. The latching member may be releasably engageable with the projection and the second end of the connector.

According to a third aspect of the present invention there is provided a quick hitch for coupling a tool to an excavation arm of an excavator, the quick hitch comprising:

a hitching member removably coupleable to an end of an excavator arm of an excavator via a first side, and configured to couple to a tool via a second side;

wherein, the hitching member is removable and interchangeable with a differently dimensioned (second) hitching member, such that in use the different (second) hitching member is removably coupleable to a correspondingly differently dimensioned (second) excavator arm of an excavator via the first side and configured to couple to said tool via a second side.

Said base plate may be removably attachable to the different (second) hitching member.

The features of the quick hitch of the third aspect of the invention are the same as the corresponding features described above with regards to the first and second aspects of the invention.

Advantageously, the excavator attachment/tool may be coupled to a variety of different dimensioned hitching members, thus allowing the same tool to be coupled to a variety of different dimensioned excavators and excavator arms. Since conventional tools have the hitching member built into the tool, and not as a separate member, the user would be required to buy several of the same tool, but with different sized inbuilt hitching members to fit different excavators. This can ultimately become very expensive. The present invention however allows the user to buy one single tool, and a variety of different dimensioned hitching members, which is significantly cheaper than buying multiple tools. Whenever the user wants to use the tool with a different excavator, they only need to interchange the hitching member, and not the entire tool. Advantageously, this will be more economical for the user.

The hitching member may comprise at least one pin. The at least one pin may be engageable with corresponding hook(s) on the excavator arm.

The quick hitch may further comprise a base plate. The base plate may be coupleable to an excavator tool via a second face. The base plate may be removably attachable to the hitching member via a first face.

The base plate may comprise two side plates located on the first face of the base plate. The hitching member may also comprise two side plates. The at least one pin may be located between two side plates of the hitching member.

The side plates of the hitching member may each comprise at least one fixing hole. The side plates of the base plate may each comprise at least one fixing hole.

The side plates of the hitching member, and the side plates of the base plate, may overlap such that the fixing holes are alignable. The quick hitch may further comprise at least one fixing member. The at least one fixing member may be arranged to removably attach the hitching member to the base plate. The alignable fixing holes may be configured to receive the at least one fixing member to removably attach the hitching member to the base plate in use. The at least one fixing member may be a nut and bolt arrangement. Alternatively, the at least one fixing member may be a screw.

The second face of the base plate may be pivotably attachable to a first side of a frame. The frame may be removably coupleable to an excavator tool.

The quick hitch may further comprise an extendible rod pivotably attachable to the second face of the base plate at a first end and pivotably attachable to a second side of the frame at a second end.

The quick hitch may further comprise a connector. The connector may comprise a first end attachable to the second side of the frame, and a second end. The second end may comprise a hollow portion.

The quick hitch may further comprise an attachment member. The attachment member may comprise a base portion for attaching to an excavator tool. The attachment member may also comprise a projection extending away from the base portion. The projection may be configured to be receivable in the hollow portion in the second end of the connector.

The quick hitch may further comprise a latching member. The latching member may be releasably engageable with the projection and also the second end of the connector.

According to a fourth aspect of the present invention there is provided a hitching kit for connecting a tool to an excavation arm of an excavator. The hitching kit comprises the quick hitch(es) and/or quick hitch unit as described according to the first and/or second and/or third aspect(s) of the invention.

According to a fifth aspect of the present invention there is provided an excavator arm and/or excavator comprising the quick hitch(es) and/or quick hitch unit according to the first and/or second and/or third aspect(s) of the invention.

According to a further aspect of the present invention there is provided a method of coupling a tool to an excavation arm of an excavator, the method comprising:

attaching an attachment member to a tool to be coupled to the excavation arm, the attachment member comprising a base portion which is coupled to the excavator tool and a projection extending away from the base portion; the base portion comprising a groove or a protrusion;

inserting the projection into a connector, the connector being hollow along at least a portion of its length; the connector is indirectly coupled to an excavation arm, and comprises a side wall, a corresponding protrusion or a corresponding groove on an end surface, and a bore extending through the side wall;

aligning and interlocking the groove/protrusion on the base portion with the corresponding protrusion/groove on the end surface of the connector; and, inserting a latching member through the bore on the side wall, and releasably engaging the latching member with the projection of the attachment member, to secure the tool to the connector.

The base portion may further comprise a second projection extending away from the base portion. The second projection may be threaded. The method may further comprise the step of screwing the second projection into a correspondingly threaded bore on the tool.

The connector may be coupled to the excavation arm via a frame. The frame may be pivotably attached to a base plate. The base plate may be removably coupled to the excavator arm.

The latching member may comprise a recess. The projection of the attachment member may also comprise a recess. After the latching member is inserted through the side wall, the method may further comprise rotating the latching member to releasably engage the two recesses.

The method may further comprise:

removably coupling a hitching member to the excavator arm; and, removably attaching the base plate to the hitching member, to secure the tool to the tool to the excavator arm.

The base plate may be removably attached to the hitching member via at least one fixing member.

An extendible rod may be pivotably attachable between the base plate and the frame. In use, the extendible rod may extend and retract to pivot the frame with respect to the base plate.

According to a further aspect of the present invention there is provided a method of removably coupling a tool to an excavator arm, the method comprising:

selecting a hitching member from a range of differently dimensioned hitching members to fit to a chosen excavator arm; the hitching member comprising a pin extending between two side plates, the side plates each comprising at least one fixing hole;

engaging the pin with corresponding hooks on the excavator arm;

aligning the at least one fixing hole of the hitching member with a corresponding fixing hole on side plates of a base plate; the base plate being pivotably attached to a frame, the frame being attached to a connector, and the connector being coupled to a tool;

removably attaching the hitching member to the base plate by inserting and securing at least one fixing member through each of the fixing holes; and, wherein, the hitching member is interchangeable with a second, differently dimensioned, hitching member, such that in use the second hitching member is removably coupled to a correspondingly differently dimensioned excavator arm of an excavator; and wherein, in use, said base plate is removably attachable to the second hitching member.

Whilst the invention has been described above, it extends to any inventive combination set out above, or in the following description or drawings.

BRIEF DESCRIPTION OF THE DRAWINGS

The invention may be performed in various ways, and an embodiment thereof will now be described by way of example only, reference being made to the accompanying drawings, in which:

FIG. 3 shows a perspective view (A), a top view (B), a side view (C) and a front view (D) of the FIG. 1 quick hitch pivoted at an angle to the horizontal axis of the quick hitch;

DETAILED DESCRIPTION OF THE DRAWINGS

Figure 1:
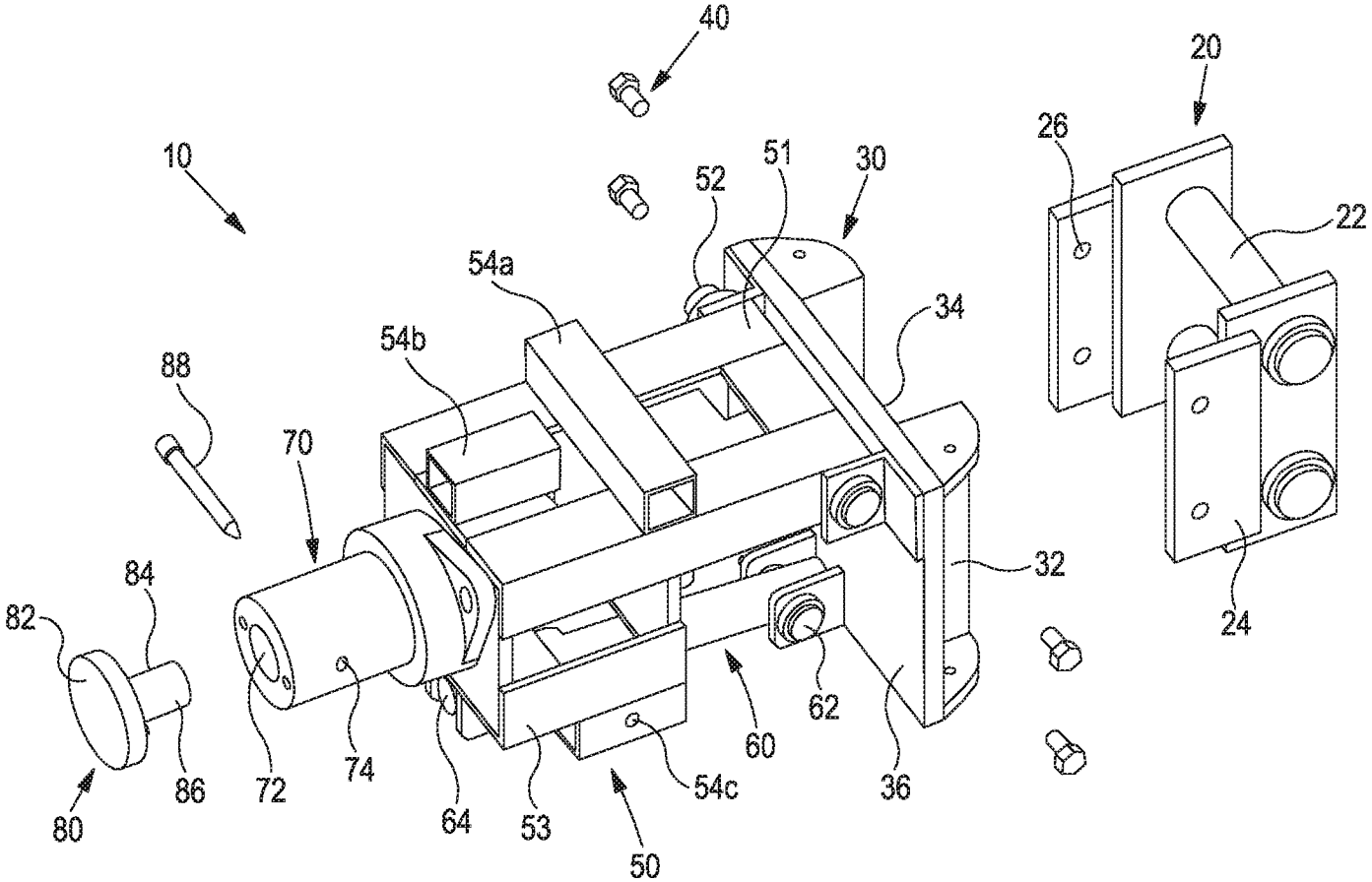
FIG. 1 shows an exploded view of a quick hitch in accordance with embodiments the present invention.
Figure 2B:
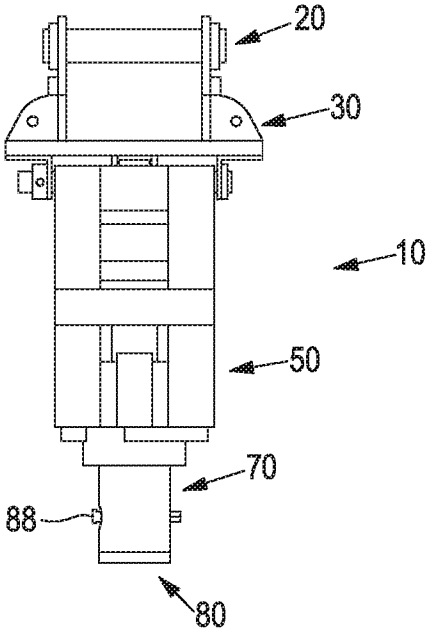
FIG. 2 shows a perspective view (A), a top view (B), a side view (C) and a front view (D) of the FIG. 1 quick hitch.
Figure 2D:
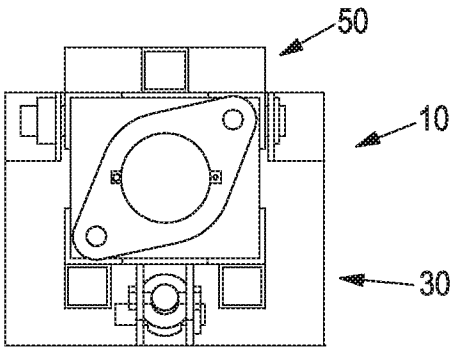
Figure 2A:
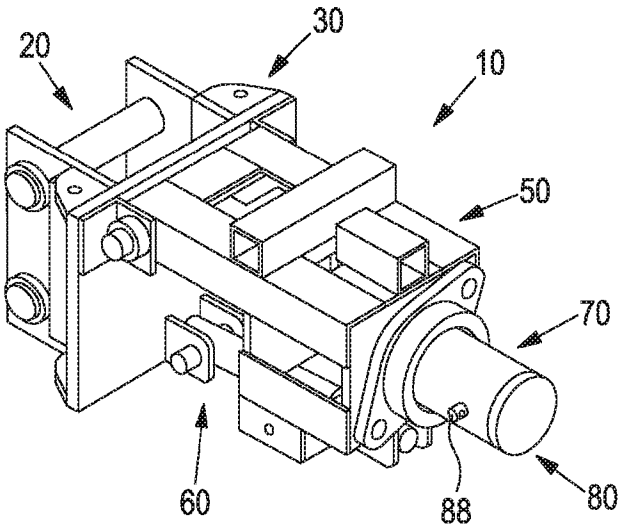
Figure 2C:
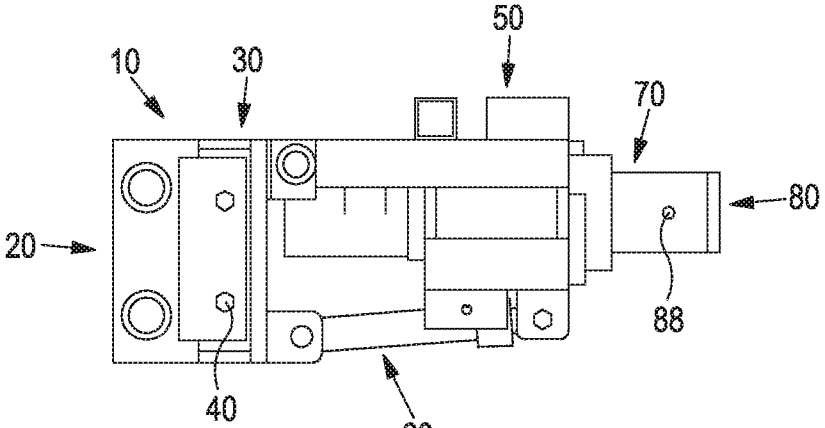

FIGS. 1, 2 and 3 show a quick hitch 10 for coupling a tool/attachment such as an excavator bucket to an excavator arm. The quick hitch 10 comprises a hitching member 20 designed to be removably coupleable to an end of an excavator arm of an excavator. The hitching member 20 comprises two pins 22 secured between two side plates 24. Each side plate 24 comprises a back part, to which the pins 22 are attached, and a front part which partially overlaps the back part. Each side plate 24 comprises two fixing holes 26 located on the front part.

The quick hitch 10 also comprises a base plate 30. The base plate 30 comprises two side plates 32 located on a first face 34 of the base plate 30. Each side plate 32 comprises two fixing holes (not shown).

The second face 36 of the base plate 30 is attached to a frame 50. The frame 50 is pivotably attached to an upper portion of the base plate 30 via a pin 52, which extends through a first side 51 of the frame 50.

Figure 7:
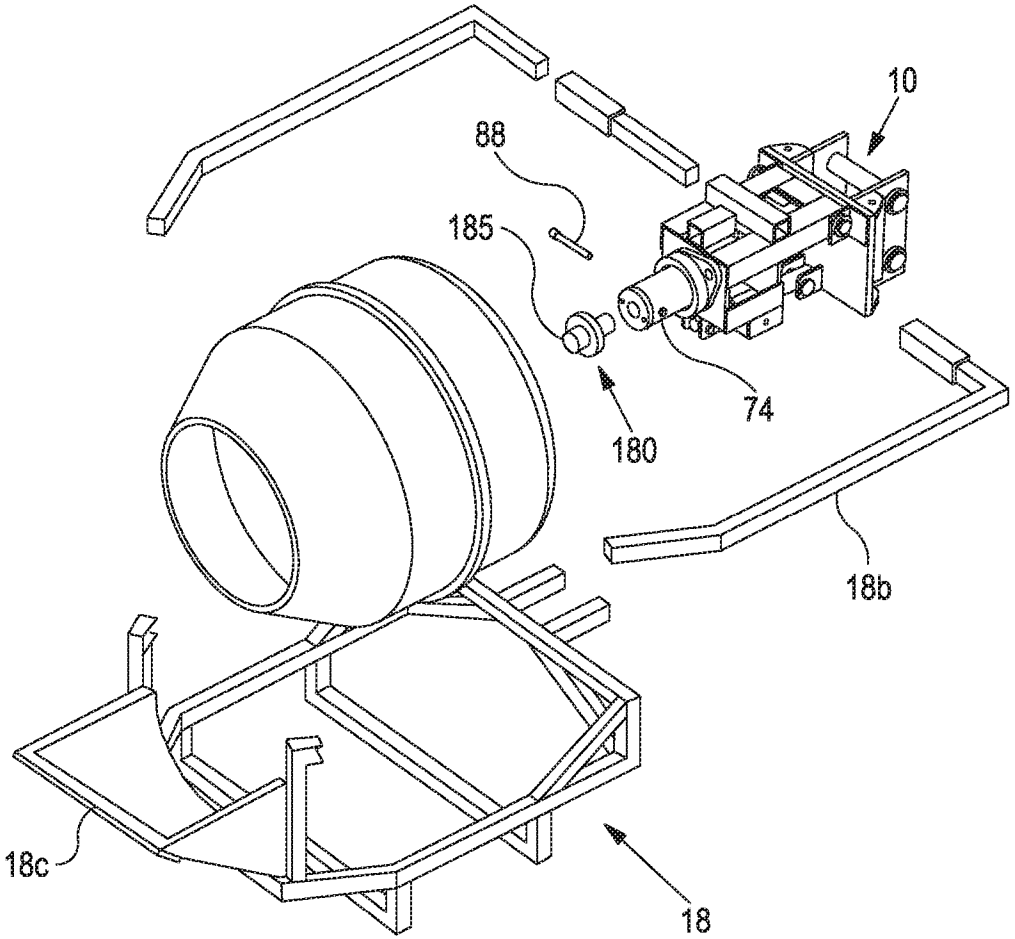
FIG. 7 shows a partially exploded view of a quick hitch comprising a mixer attachment in accordance with embodiments of the present invention.
Figure 8B:
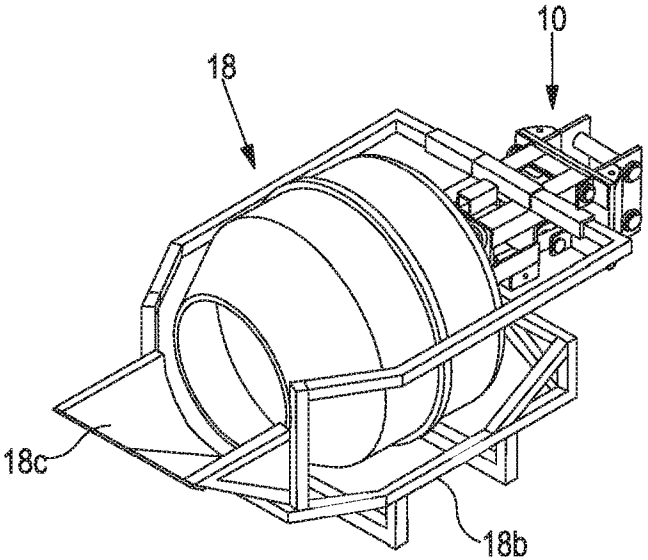
FIG. 8 shows a rear perspective view (A), a front perspective view (B), a top view (C), and a side view (D) of the FIG. 7 quick hitch.
Figure 8D:
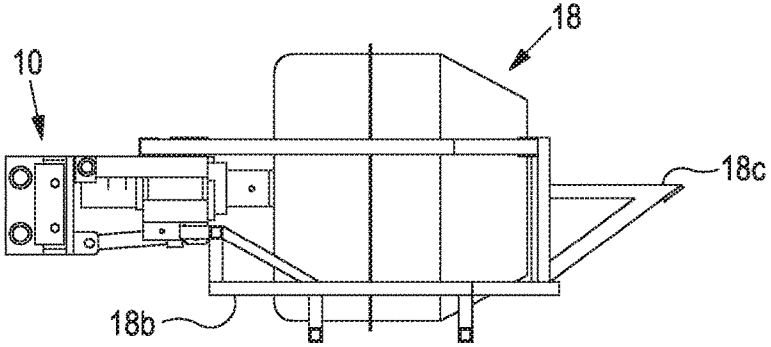
Figure 8A:
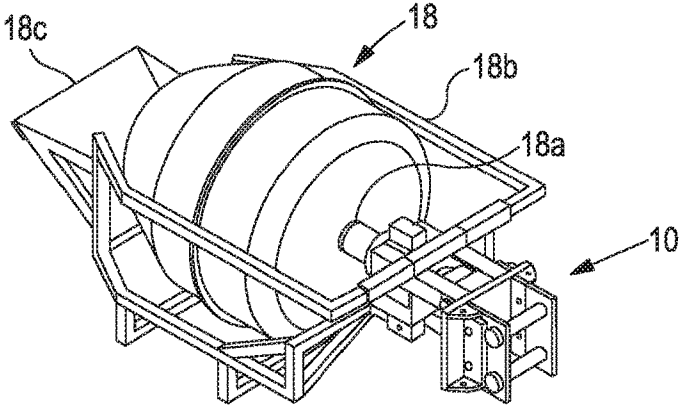
Figure 8C:
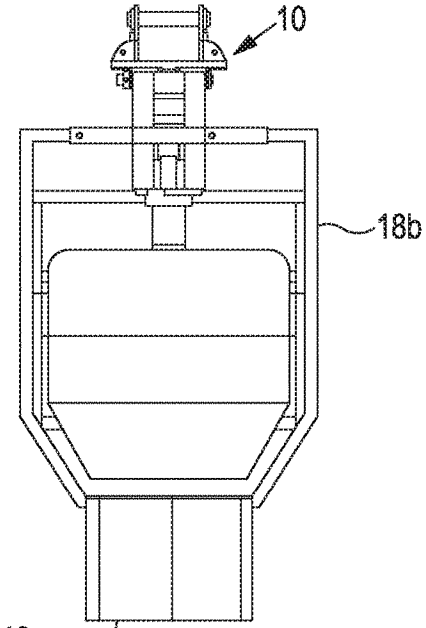

The frame 50 comprises several elongate hollow sections such as 54*a*, 54*b* and 54*c*. Hollow sections 54*a* and 54*b* are located on top of the frame 50, and 54*c* is located underneath the frame. Hollow section 54*a* is perpendicular to the longitudinal axis of the quick hitch 10. Hollow sections 54*b* and 54*c* are parallel to the longitudinal axis of the quick hitch 10. As shown in FIGS. 7 and 8, some tools (such as a mixer attachment) comprise a frame. In use, sections of the tool frame are designed to engage with the hollow sections 54*a*, 54*b*, 54*c* of frame 50, which advantageously provides additional support for the tool during use.

The second face of the base plate 30 is also attached to an extendible rod 60. The extendible rod 60 is pivotably attached to a lower portion of the base plate 30 via a pin 62, which extends through a first end of the rod 60. The frame 50 and the rod 60 pivot around parallel axes of rotation. A second end of the rod 60 is pivotably attached to a second side 53 of the frame 60 via a pin 64.

The second side 53 of the frame 50 is also attached to a connector 70. In this example, the connector 70 is cylindrical in shape, but it may conceivably be any other suitable shape. The connector 70 comprises a hollow center 72 which extends through at least a portion of the connector 70.

The quick hitch 10 further comprises an attachment member 80. The attachment member 80 comprises a base portion 82 which is designed to attach to a tool in use. The base portion 82 may be welded or bolted to the tool. The attachment member 80 further comprises a projection 84 extending away from the base portion 82.

In use, firstly, the two pins 22 of the hitching member 20 engage with corresponding hooks (not shown) on an excavator arm (not shown). When the pins 22 are engaged with the corresponding hooks, they may be secured in place by any mechanism known in the field (such as a hydraulic latching mechanism).

The base plate 30 is then attached to the hitching member 20. The back part of side plates 24 abut side plates 32, and the front part of side plates 24 overlap side plates 32. The fixing holes on side plates 24 align with the corresponding fixing holes on side plates 32, and each receive a bolt 40, secured in place by a nut (not shown).

The nut and bolt arrangement 40 is in use removable to allow the hitching member 20 to be removed from the base plate 30. In use, the hitching member 20 can be removed and replaced with a different hitching member 20. The different hitching member may have different sized/dimensioned pins (length and/or diameter) to engage with different excavators having different arm sizes, whilst still being attachable to the same base plate 30 (and same tool). Advantageously this allows the tool to be coupled to any size or type of excavator.

The base portion 82 of the attachment member 80 is attached to a tool. The hollow center 72 of the connector 70 then receives the projection 84. Both the connector 70 and the projection 84 comprise holes 74, 86 which in use are aligned, and are secured in place by a pin 88 received through both holes 74 and 86. Advantageously, this allows the tool to be quickly and easily fitted, removed, and replaced with another tool.

Once the tool is coupled to the excavator arm, it is ready for use. During use, actuation of rod 60 (either hydraulically, pneumatically, electrically, manually, or by other suitable means) causes the rod 60 to extend in length. Extension of the rod 60 causes the rod 60 to pivot upwards around pin 62 and also pin 64, and also causes frame 50 to pivot upwards around pin 52 relative to base plate 30 (see FIG. 3). Whichever tool is coupled to the quick hitch 10 will also move upwards along with the frame 50. Advantageously, this provides a greater range of movement of the tool compared to conventional excavators.

Conversely, subsequent compression of the rod 60 causes the rod 60 to pivot downwards around pin 62 and also pin 64, and also causes frame 50 to pivot downwards around pin 52 relative to base plate 30. Whichever tool is coupled to the quick hitch 10 will also move downwards along with the frame 50.

Figure 4A:
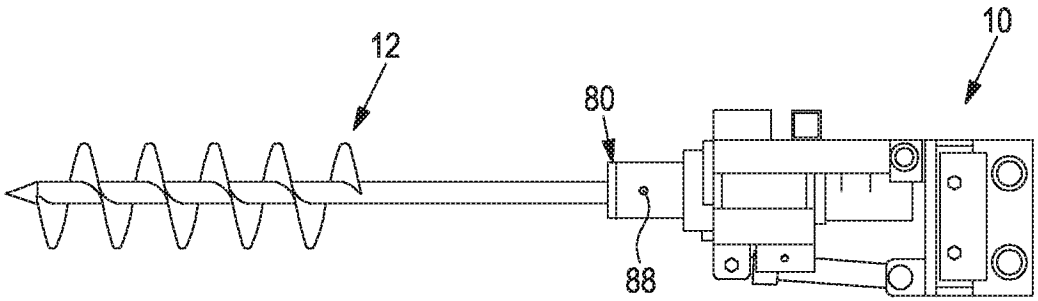
FIG. 4 shows the FIG. 1 quick hitch comprising a post drill tool according to embodiments of the present invention.
Figure 4B:
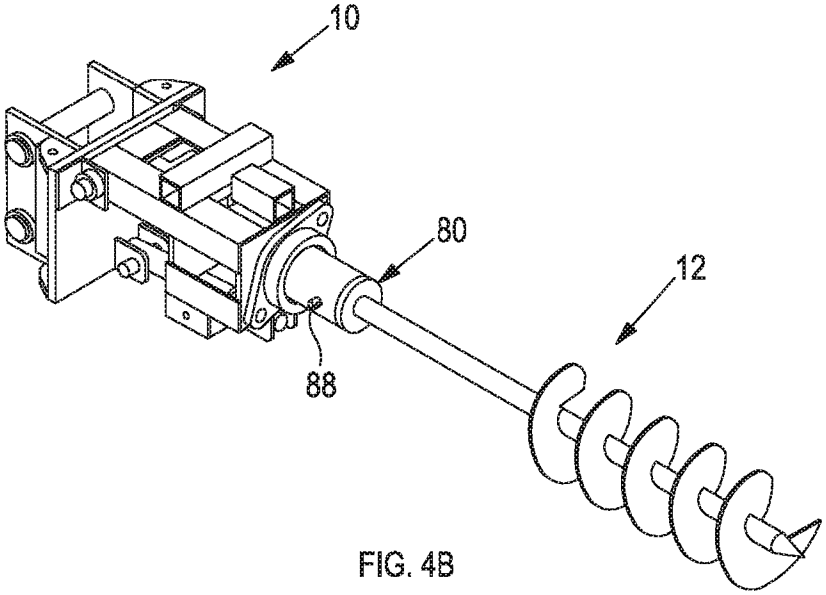

FIGS. 4-8 show various tools coupled to the quick hitch 10. FIG. 4 shows the quick hitch 10 comprising a post drill tool 12. The base portion 82 of the attachment member 80 is attached to the end of the port drill tool 12. The post drill tool 12 is then coupled to the connector 70 as described above.

Figure 5B:
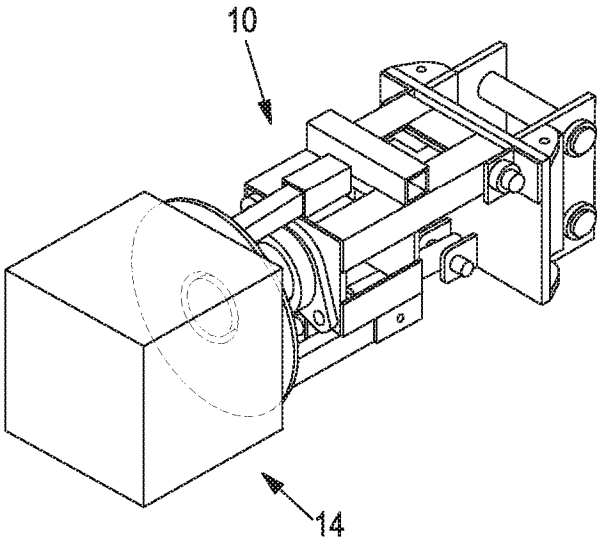
FIG. 5 shows a partially exploded view of the FIG. 1 quick hitch comprising a generator/pump attachment in accordance with embodiments of the present invention.
Figure 5A:
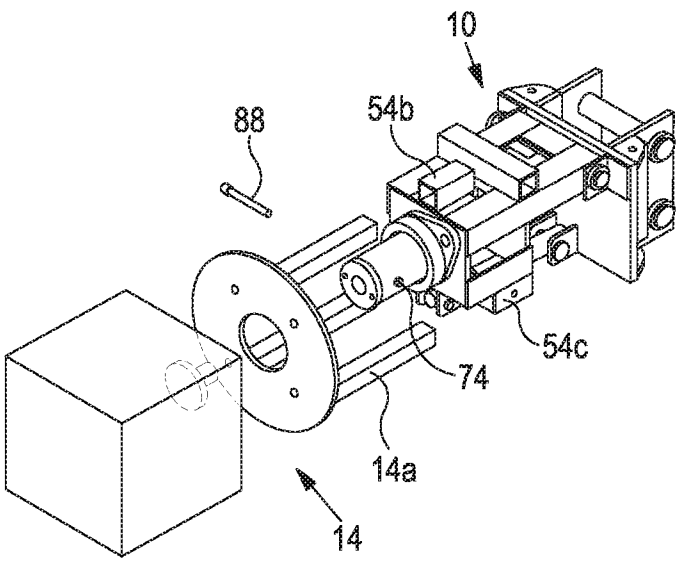
Figure 5C:
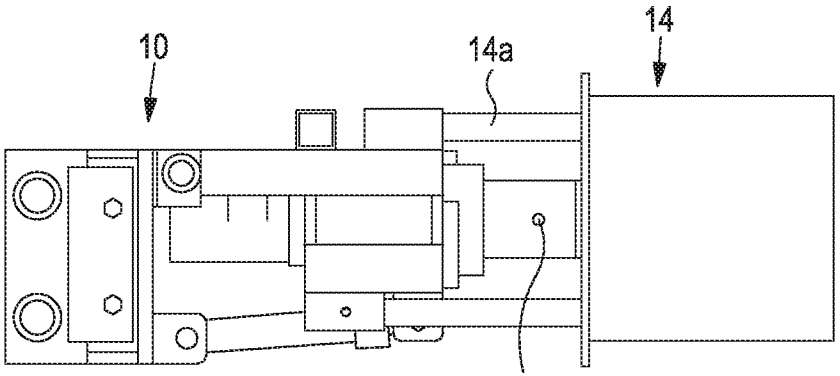

FIG. 5 shows the quick hitch 10 comprising a generator/pump attachment 14. The base portion 82 of the attachment member 80 is attached to the generator/pump attachment 14, and then coupled to the connector 70 as described above. The attachment 14 further comprises a frame 14*a*. The frame 14*a* is bolted to the attachment 14, and comprises three "legs" which engage with hollow sections 54*b* and 54*c* (which are parallel to the longitudinal axis of the quick hitch 10). This provides additional support for attachment 14 during use. The frame 14*a* may also be provided with other attachments which require additional support.

Figure 6B:
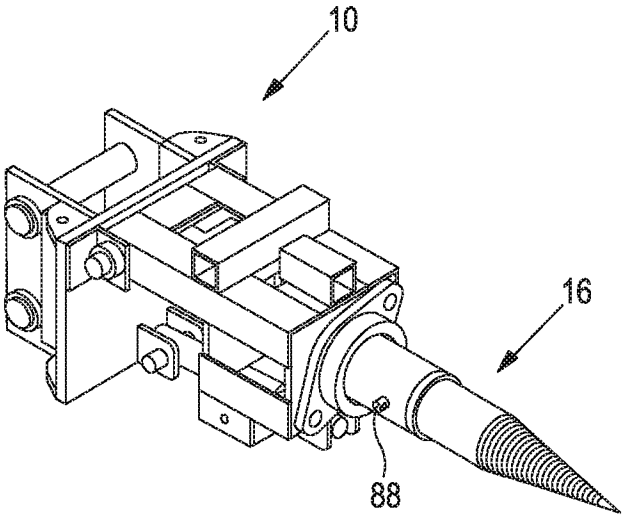
FIG. 6 shows the FIG. 1 quick hitch comprising a log splitter attachment according to embodiments of the present invention.
Figure 6A:
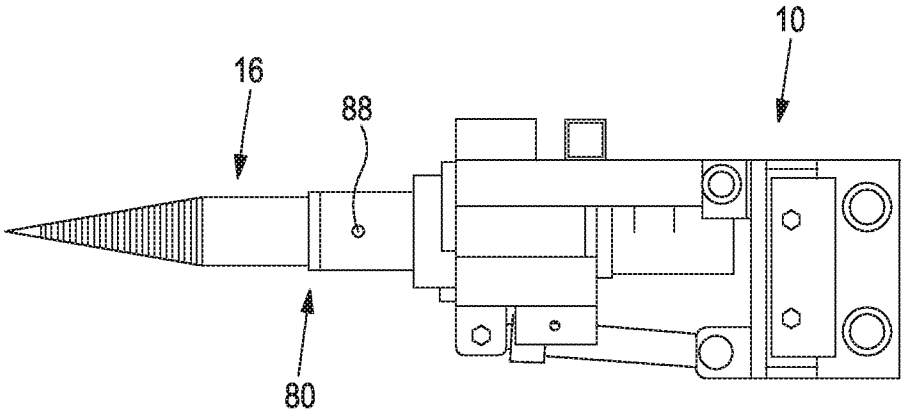

FIG. 6 shows the quick hitch 10 comprising a log splitter attachment 16. The base portion 82 of the attachment member 80 is attached to the end of the log splitter attachment 16. The log splitter attachment 16 is then coupled to the connector 70 as described above.

FIGS. 7 and 8 show the quick hitch 10 comprising a mixer attachment 18. This embodiment comprises a different attachment member 180. Attachment member 180 comprises the same projection 84, but additionally comprises a second projection 185 extending away from the base portion 82. The second projection 185 is threaded. The second projection 185 engages with a corresponding hole 18*a* (see FIG. 8(A)) located on the rear of the mixer attachment 18. The mixer attachment 18 then couples to the connector 70 via projection 84 as described above. The mixer attachment 18 further comprises a frame 18*b*. The frame 18*b* comprises several separate sections, as shown in FIG. 7. These sections are secured together, and also engage with hollow sections 54*a* and 54*c* to provide additional support for the attachment 18. The frame 18*b* also comprises a shovel 18*c* which can help to direct material into and out of the mixer 18.

Figure 9A:
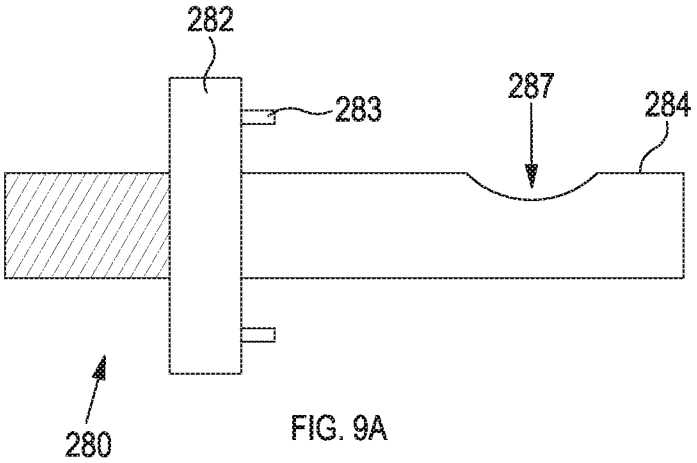
FIG. 9 shows an alternative arrangement of an attachment member for coupling a tool to the quick hitch; and, FIG. 10 shows a further alternative arrangement of an attachment member for coupling a tool to the quick hitch.
Figure 9B:
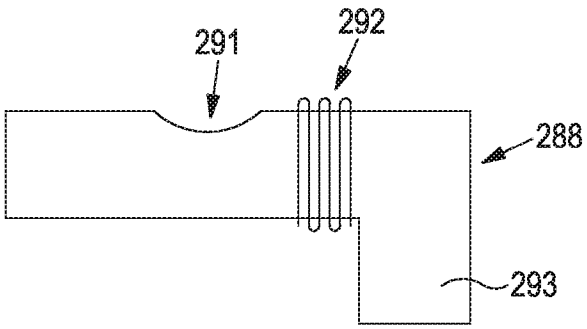

FIG. 9A shows an alternative embodiment of the attachment member 280, comprising a base portion 282 and a projection 284. The base portion 282 comprises protrusions in the form of tabs 283, and the projection 284 comprises a cut-out or recess 287. The cut-out 287 may be rounded in shape, or alternatively it may be square shaped. Compared to previous embodiments, the attachment member shown in FIG. 9 does not comprise holes through which a pin can be received. FIG. 9B shows an alternative embodiment of pin 288. The pin 288 comprises a corresponding cut-out or recess 291. The corresponding cut-out 291 may also be rounded in shape, or alternatively it may be square shaped. The pin 291 also comprises a handle 293, and a spring 292 is located on the pin 288 adjacent to the handle 293.

Figure 9C:
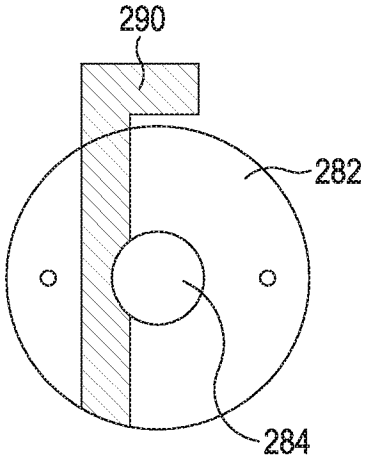
Figure 9D:
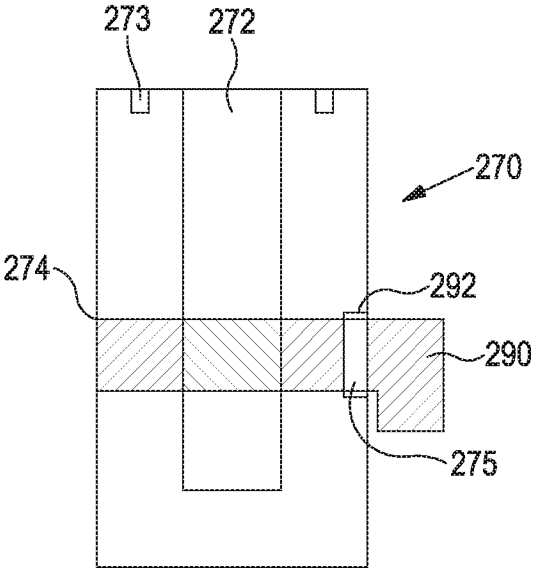

FIGS. 9C and 9D show a connector 270 which comprises a hollow center 272. The hollow center 272 extends through at least a portion of the connector 270. The connector 270 also comprises grooves in the form of slots 273. The connector 270 further comprises holes 274, and also a recess 275.

In use, as before, the base portion 282 of the attachment member 280 is attached to a tool (for example, by bolting or welding). The projection 284 is then inserted into the hollow center 272 of the connector 270. The attachment member 280 is rotated if needed such that the tabs 283 on the base portion 282 engage with the slots 273 on the connector 270. The engagement of the tabs 283 and the slots 273 provides the correct orientation of the cut-out 287 on the projection 284 within the connector 270.

The pin 288 is then inserted through one of the holes in the connector 270, and slides past the correctly orientated cut-out 287 until the spring 292 is located within the recess 275. The handle 293 of the pin 288 is then rotated until the corresponding cut-out 291 on the pin 288 engages with the cut-out 287 on the attachment member 280. The pin 288 is now locked in place and the tool is securely attached to the quick hitch 10. The spring 292 is compressed in use, and held in the compressed/energised position when the two cut-outs/recesses are engaged.

An advantage of providing the spring may be to help minimise vibrations transmitted to the pin during use. The spring may additionally help to mitigate the risk that the pin will move/rotate and eventually work itself free during use, potentially resulting in the tool detaching from the quick hitch.

Figure 10E:
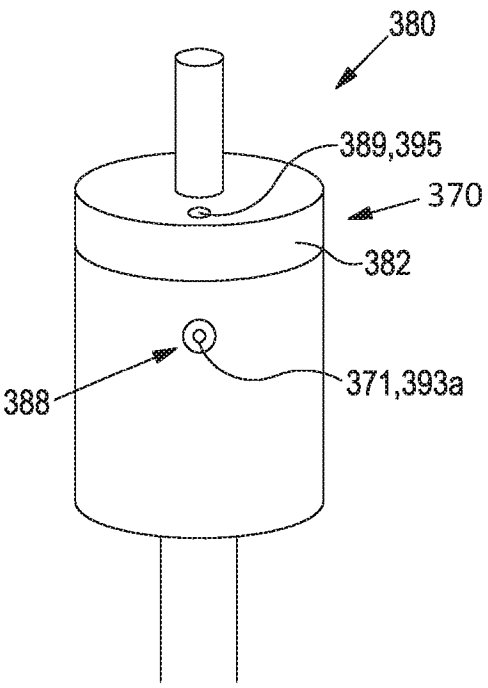
Figure 10C:
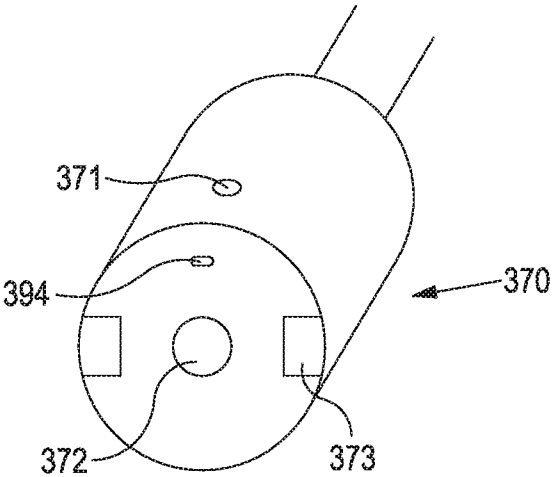
Figure 10D:
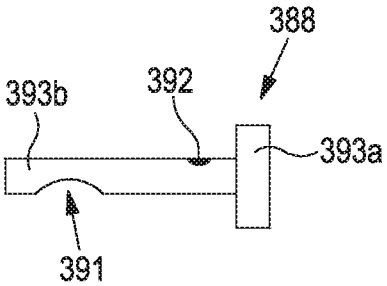
Figure 10A:
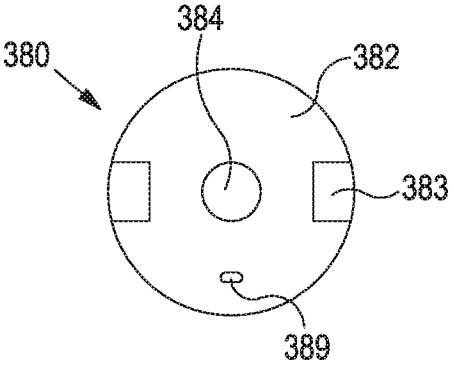
Figure 10B:
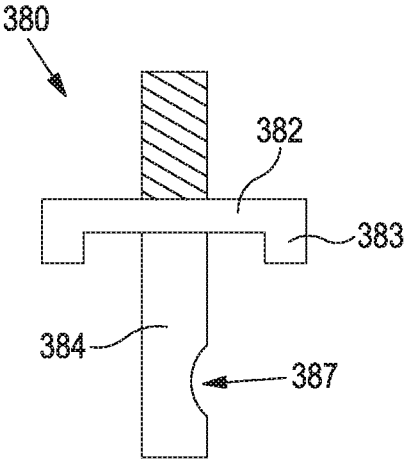

FIGS. 10A and 10B show a further alternative embodiment of the attachment member 380, comprising a base portion 382 and a projection 384. The base portion 382 comprises protrusions in the form of tabs or lugs 383, and the projection 384 comprises a cut-out 387. The cut-out 387 may be rounded in shape, or alternatively it may be square shaped. FIG. 10C shows a connector 370 which comprises a hollow center 372. The hollow center 372 extends through at least a portion of the connector 370. The connector 370 also comprises grooves or cut-outs 373, into which the lugs 383 are located in use.

Base portion 382 comprises a through bore 389. Connector 370 also comprises a bore 394, which aligns with through bore 389 when the lugs 383 are located within grooves 373 in the correct orientation.

FIG. 10D shows an alternative embodiment of pin 388, which in this embodiment is an allen key bolt. The bolt 388 comprises a corresponding cut-out 391 on shaft 393*b*, and also comprises a dimple 392. The corresponding cut-out 391 may also be rounded in shape, or alternatively it may be square shaped. The bolt 388 comprises a head 393*a* into which an allen key can fit to rotate the bolt 388 into position in use.

As shown in FIG. 10E, in use the base portion 382 of the attachment member 380 is attached to a tool (for example, by bolting, welding, or screwing). The projection 384 is then inserted into the hollow center 372 of the connector 370. The attachment member 380 is rotated if needed such that the lugs 383 on the base portion 382 engage with the cut-outs 373 on the connector 370. The engagement of the lugs 383 and the cut-outs 373 provides the correct orientation of the cut-out 387 on the projection 384 within the connector 370.

The bolt 388 is then inserted through the hole 371 on the side of the connector 370, and slides past the correctly orientated cut-out 387. An allen key (not shown) is then used to rotate the bolt 388 until the cut-out 391 on the bolt 388 engages with the cut-out 387 on the attachment member 380. In use, when bolt 388 is fully inserted into the connector 370, the dimple 392 is also aligned with bores 389 and 394. The bolt 388 is secured in place by inserting a screw, such as a spring plunger grub screw 395 through bores 389 and 394. The grub screw 395 comprises a sprung ball bearing (not shown), which is located within the dimple 392 when the grub screw is fully inserted. The grub screw is then tightened to provide increased friction between the grub screw 395 and the bolt 388, to secure the bolt 388 in place. The tool is now securely attached to the quick hitch 10.

Although the invention has been described above with reference to an exemplary embodiment, it will be appreciated that various changes or modifications may be made without departing from the scope of the invention as defined in the appended claims.

For example, the grooves and protrusions of FIG. 9 may alternatively be any suitable features which engage when the correct orientation of the attachment member within the connector has been achieved. For example, the grooves may be machined valleys and the protrusions may be corresponding machined ridges. The connector may instead comprise the protrusions, and the base portion may instead comprise the grooves.

The invention claimed is:

1. A quick hitch for coupling a tool to an excavation arm of an excavator, the quick hitch comprising:

a cylindrical connector having:

a hollow center extending through at least a portion of the length of the connector;

a first end coupleable to an excavation arm; and a second end coupleable to a tool;

a latching member releasably engageable with the second end of the connector;

wherein in use the second end of the connector receives the tool, and the latching member engages with the connector to releasably couple the tool to the connectors;

the quick hitch further comprising:

a frame having first and second sides;

a base plate having first and second faces; and, an extendible rod having a first end and a second end;

wherein:

the first face of the base plate is removably coupleable to an end of an excavator arm of an excavator;

the second face of the base plate is pivotably attached to the first side of the frame and the first end of the extendible rod;

the second end of the extendible rod is pivotably attached to the second side of the frame; and, the first end of the connector is attached to the second side of the frame, such that the cylindrical connector is coupleable to an excavation arm via the frame.

2. The quick hitch as claimed in claim 1, further comprising an attachment member.

3. The quick hitch as claimed in claim 2, wherein the attachment member comprises a base portion for attaching to an excavator tool, and a projection extending away from the base portion.

4. The quick hitch as claimed in claim 3, wherein the hollow centre extends to the second end of the connector, the projection being receivable within the hollow center.

5. The quick hitch as claimed in claim 4, wherein the attachment member comprises a groove or a protrusion, and the connector comprises a corresponding protrusion or corresponding groove respectively, such that in use the groove and corresponding protrusion interlock when the projection is fully received within the hollow center.

6. The quick hitch as claimed in claim 3, wherein the latching member is releasably engageable with the projection and the second end of the connector to releasably couple the projection with the connector.

7. The quick hitch as claimed in claim 6, wherein the latching member is a pin extendable through alignable through holes on the projection and the second end of the connector.

8. The quick hitch as claimed in claim 6, wherein the latching member is a sprung pin.

9. The quick hitch as claimed in claim 6, wherein the latching member is a bolt, such as an allen key bolt, the bolt being secured in place by a fixing member extending through a top surface of the connector, substantially perpendicular to the bolt.

10. The quick hitch as claimed in claim 3, wherein the base portion is a flat disc.

11. The quick hitch as claimed in claim 3, wherein the base portion further comprises a second projection extending away from the base portion.

12. The quick hitch as claimed in claim 11, wherein the second projection is threaded.

13. The quick hitch as claimed in claim 1, further comprising a hitching member removably coupleable to an end of an excavator arm of an excavator, and wherein the hitching member is removably attachable to the first face of the base plate.

14. The quick hitch as claimed in claim 13, wherein the hitching member comprises at least one pin engageable with corresponding hooks on the excavator arm.

15. The quick hitch as claimed in claim 13, wherein the base plate comprises two side plates located on the first face of the base plate, and wherein the hitching member comprises two side plates located on the second side of the hitching member; and wherein the side plates of the hitching member each comprise at least one fixing hole, and the side plates of the base plate each comprise at least one fixing hole; and wherein the side plates of the hitching member, and the side plates of the base plate, overlap such that the fixing holes are alignable; and wherein the alignable fixing holes are configured to receive at least one fixing member to removably attach the hitching member to the base plate.

16. The quick hitch as claimed in claim 15, wherein the at least one fixing member is a nut and bolt arrangement.

17. A method of coupling a tool to an excavation arm of an excavator, the method comprising the steps of:

providing a quick hitch as claimed in claim 1;

attaching an attachment member to the tool to be coupled to the excavation arm, the attachment member comprising a base portion which is coupled to the excavator tool and a projection extending away from the base portion; the base portion comprising a groove or a protrusion;

inserting the projection into the cylindrical connector, the connector comprising a side wall, a corresponding protrusion or a corresponding groove on an end surface, and a bore extending through the side wall;

aligning and interlocking the groove/protrusion on the base portion with the corresponding protrusion/groove on the end surface of the connector; and, inserting the latching member through the bore on the side wall, and releasably engaging the latching member with the projection of the attachment member, to secure the tool to the connector.

18. The method as claimed in claim 17, wherein the latching member comprises a recess and the projection of the attachment member comprises a corresponding recess, and wherein the method may further comprise the step of rotating the latching member to releasably engage the two recesses.

19. The method as claimed in claim 17, further comprising the steps of:

removably coupling a hitching member to the excavator arm; and, removably attaching the base plate to the hitching member, to secure the tool to the excavator arm;

wherein the hitching member comprises at least one pin engageable with corresponding hooks on the excavator arm; and, wherein the hitching member is removably attachable to the first face of the base plate, thereby removably coupling the base plate to an end of an excavator arm of an excavator via the hitching member.

20. A method of removably coupling a tool to an excavator arm, the method comprising the steps of:

providing a quick hitch as claimed in claim 1;

selecting a hitching member from a range of differently dimensioned hitching members to fit to a chosen excavator arm; the hitching member comprising a pin extending between two side plates, the side plates each comprising at least one fixing hole, engaging the pin with corresponding hooks on the excavator arm;

aligning the at least one fixing hole on each side plate of the hitching member with corresponding fixing holes on side plates located on the first face of the base plate; the base plate being pivotably attached to the frame, the frame being attached to the connector, and the connector being coupled to the tool;

removably attaching the hitching member to the first face of the base plate by inserting and securing at least one fixing member through each of the aligned fixing holes; and, wherein, the hitching member is interchangeable with a second, differently dimensioned, hitching member, such that in use the second hitching member is removably coupled to a correspondingly differently dimensioned excavator arm of an excavator; and, wherein, in use, the base plate is removably attachable to the second hitching member.

* * * * *